US005236318A

United States Patent [19]

Richardson, Jr.

[11] Patent Number: 5,236,318

[45] Date of Patent: Aug. 17, 1993

[54] ORBITING ROTARY COMPRESSOR WITH ADJUSTABLE ECCENTRIC

[75] Inventor: Hubert Richardson, Jr., Brooklyn, Mich.

[73] Assignee: Tecumseh Products Company, Tecumseh, Mich.

[21] Appl. No.: 778,517

[22] Filed: Oct. 18, 1991

[51] Int. Cl.[5] ..... F04C 18/356; F04C 29/00

[52] U.S. Cl. ..... 418/1; 418/57; 418/63; 418/109

[58] Field of Search ..... 418/1, 29, 63, 107, 418/108, 109, 181, 57

[56] References Cited

U.S. PATENT DOCUMENTS

| | | | |
|---|---|---|---|
| 300,629 | 6/1884 | Nash . | |
| 353,703 | 12/1886 | Nash . | |
| 433,088 | 7/1890 | Nash . | |
| 517,986 | 4/1894 | Smith | 418/109 |
| 713,301 | 11/1902 | Hagerty | 418/109 |
| 910,175 | 1/1909 | Cole . | |
| 1,683,390 | 9/1928 | Kagi . | |
| 1,817,735 | 8/1931 | Clark | 418/57 |
| 1,961,592 | 6/1934 | Muller . | |
| 1,973,670 | 11/1934 | Star . | |
| 2,100,014 | 11/1937 | McCracken . | |
| 2,187,730 | 1/1940 | Davidson . | |
| 2,266,191 | 12/1941 | Granberg . | |
| 2,423,507 | 7/1947 | Lawton . | |
| 2,859,911 | 11/1958 | Reitter . | |
| 2,965,288 | 12/1960 | Butler . | |
| 3,563,678 | 2/1971 | Sadler | 418/6 |
| 3,683,694 | 8/1972 | Granberg | 73/259 |
| 3,909,161 | 9/1975 | Stenner | 418/6 |
| 3,977,369 | 8/1976 | Spark | 123/8.43 |
| 4,005,951 | 2/1977 | Swinkels | 418/61.1 |
| 4,086,039 | 4/1978 | Ettridge | 418/61.1 |
| 4,219,314 | 8/1980 | Haggerty | 418/29 |
| 4,235,572 | 11/1980 | Winkler | 418/6 |
| 4,239,466 | 12/1980 | Abbey | 418/29 |
| 4,406,600 | 9/1983 | Terauchi | 418/55.3 |
| 4,508,495 | 4/1985 | Monden et al. | 418/63 |
| 4,637,786 | 1/1987 | Matoba | 418/55.6 |
| 4,875,838 | 10/1989 | Richardson | 418/55.4 |

FOREIGN PATENT DOCUMENTS

| | | | |
|---|---|---|---|
| 3536714A1 | 4/1986 | Fed. Rep. of Germany . | |
| 61-11488 | 1/1986 | Japan . | |
| 64-41690 | 2/1989 | Japan | 418/109 |
| 2224079 | 4/1990 | United Kingdom | 418/29 |

*Primary Examiner*—John J. Vrablik
*Attorney, Agent, or Firm*—Baker & Daniels

[57] ABSTRACT

An adjustable eccentric mechanism for an orbiting rotary compressor comprising an eccentric, disposed within an orbiting roller, pivotally engaging a crankshaft and locking means for locking the eccentric to the crankshaft in a manner permitting adjustment of the eccentricity of the roller. A method of setting the eccentricity of an orbiting roller by swinging the roller around within the cylinder chamber into contact or a specified clearance with the sidewall, then locking the roller eccentric into place.

17 Claims, 3 Drawing Sheets

ORBITING ROTARY COMPRESSOR WITH ADJUSTABLE ECCENTRIC

BACKGROUND OF THE INVENTION

The present invention generally relates to refrigeration compressors and more particularly to such compressors having an orbiting roller member wherein it is possible to adjust the eccentricity of the orbiting roller member.

Rotary compressors have advantages over other types of compressors by virtue of their high efficiency, small size and low cost. Disadvantages of rotary compressors lie in the necessity of close tolerances between the roller and cylinder wall and the high cost of manufacturing parts with such close tolerances. High precision parts have been necessary since there has been no other totally effective way to match the roller with the cylinder, except by mechanically centering the roller and bolting the main bearing in a specific position and to prevent leakage between the roller and the cylinder walls.

Another disadvantage of rotary compressors is that of wear on the roller. If the roller has a flat spot worn in, the flat rotates around the cylinder wall causing a moving leak.

The present invention is directed to overcoming the aforementioned disadvantages wherein it is desired to provide an adjustable eccentric within the orbiting cylindrical roller to facilitate sealing and prevent leakage between the cylindrical roller and cylinder chamber wall.

SUMMARY OF THE INVENTION

The present invention overcomes the disadvantage of the above described prior art compressors by providing an adjustable eccentric within the orbiting or rotating roller to adjust the eccentricity of the roller and permit proper sealing between the orbiting roller and cylinder chamber.

Generally the present invention provides a compressor comprising a cylinder and a cylindrical roller. The roller is caused to orbit, preferably by means of an Oldham ring disposed between the roller and drive mechanism. An adjustable eccentric is disposed within the roller and pivotally engages the drive means.

More specifically the invention provides, in one form thereof, an eccentric pivoting upon a pin disposed between the eccentric and drive means and a locking slot through the eccentric into which a locking means, such as a screw, bolt, or rivet, may be fastened to lock the eccentric and drive means together.

A method is disclosed whereby the eccentricity of the roller within the cylinder chamber can be set by swinging the roller inside the cylinder chamber and rotating the eccentric relative to the crankshaft until the roller is in a position where it contacts the side wall of the cylinder chamber, then locking the eccentric to the crankshaft, for example, by means of a screw through the eccentric.

In another aspect of the invention, the locking step is accomplished by inserting a tool through a hole in the top of the cylinder to lock the eccentric to the drive means. The hole in the cylinder top plate allows a screwdriver access to the screw through the roller and eccentric.

An advantage of the instant invention is that lower precision part tolerances may be used therefore reducing the expense of the compressor. Prior to this invention, high precision parts were needed to ensure an adequate seal between the roller and cylinder and extensive parts matching was necessary. By having the eccentricity dependent upon an adjusted position of the eccentric, instead of the dimensions of the parts, parts of lower precision may be used.

Another advantage of the compressor of the present invention is that the eccentricity of the roller can be set after the compressor has been assembled therefore making assembly quicker and easier.

Yet another advantage of the compressor of the present invention is that sealing of the orbiting roller with the cylinder chamber is accomplished effectively without excessive leakage between the discharge pressure region and suction pressure region of the compressor.

Another advantage of the present invention is the provision of a simple and reliable means for adjusting the eccentricity of the compressor roller.

The invention, in one form thereof, provides an orbiting rotary type compressor for compressing a refrigerant fluid. The compressor comprises a hermetically sealed housing, a cylinder within the housing having a chamber with a sidewall, and an orbiting cylindrical roller eccentrically disposed within the chamber creating a pocket. The pocket is divided by at least one vane sealing between the roller and chamber sidewall. An adjustment means for adjusting the eccentricity of the roller in relation to the chamber is disposed within the housing. Also included in the compressor are a suction port and discharge port in communication with the pocket within the chamber.

In accordance with one aspect of the previously described form of the invention the adjustment means comprises an eccentric having a top and bottom, where the eccentric bottom is pivotally engaged with the drive means or crankshaft. The eccentric, which is disposed within the roller, includes a locking slot extending through the eccentric. A locking means for locking the eccentric to the crankshaft is also included, locking through the locking slot into the crankshaft to prevent the eccentric from pivoting upon the crankshaft.

According to a further aspect of the invention, the eccentric pivots upon a pin disposed between the eccentric and drive means, when not locked to the drive means. The locking means may comprise a screw, bolt, rivet or other fastener.

In accord with another aspect of the invention, the compressor cylinder has an access hole large enough for entry of a tool or screwdriver to engage the adjustment means.

According to a further aspect of the invention, the drive means comprises an electric motor attached to one side of the cylinder with a rotation prevention means such as an Oldham ring disposed between the motor and roller.

In another form of the invention, a method of adjusting the eccentricity of the roller is disclosed comprising the steps of swinging the roller inside the cylinder chamber and rotating the eccentric relative to the crankshaft until the roller is in a position where it contacts, or is a specific clearance from, a sidewall of the cylinder chamber. Then with the roller in that position, the eccentric is locked to the crankshaft, thereby fixing the eccentricity of the roller.

According to a further aspect of the invention, the locking step is accomplished by inserting a tool, such as a screwdriver, through the cylinder to lock the eccentric to the crankshaft.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
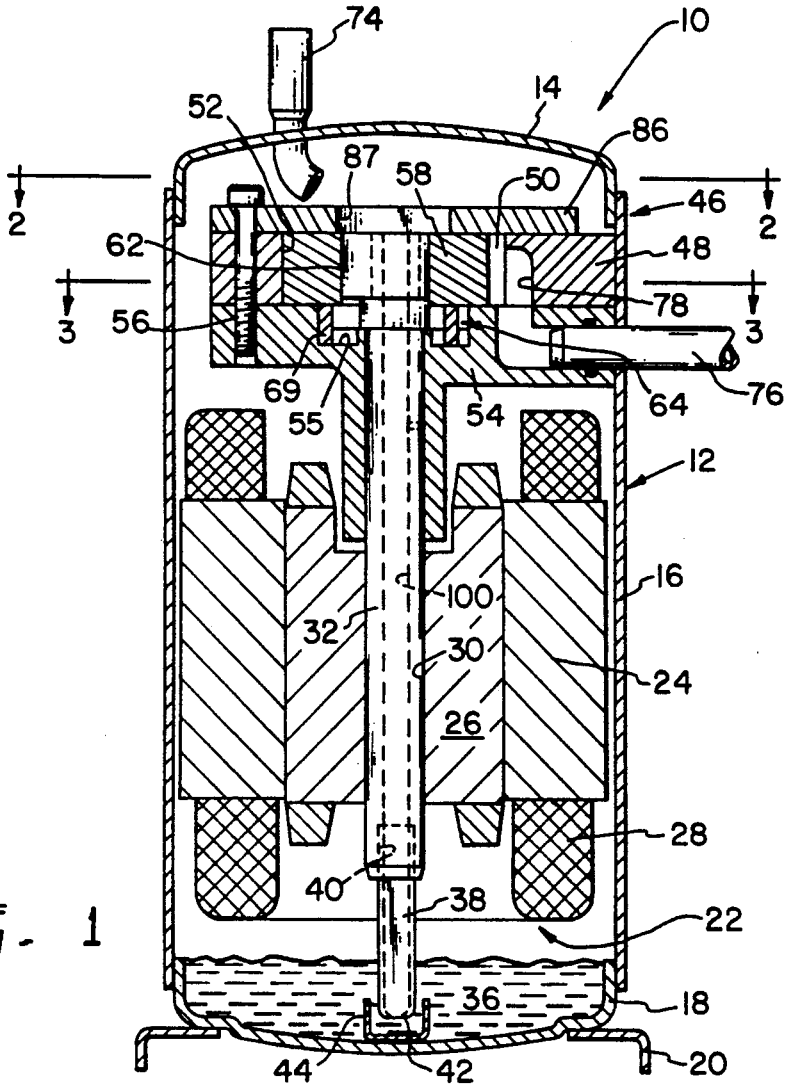
FIG. 1 is a longitudinal sectional view of the compressor of the present invention.
Figure 2:
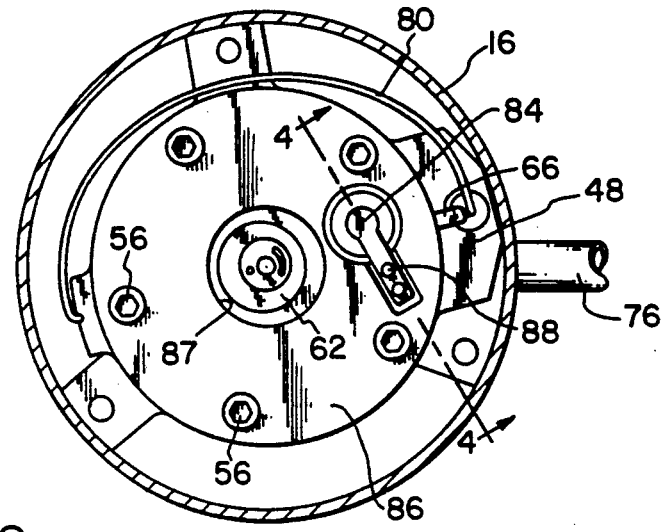
FIG. 2 is a sectional view taken along line 2—2 of FIG. 1.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 3:
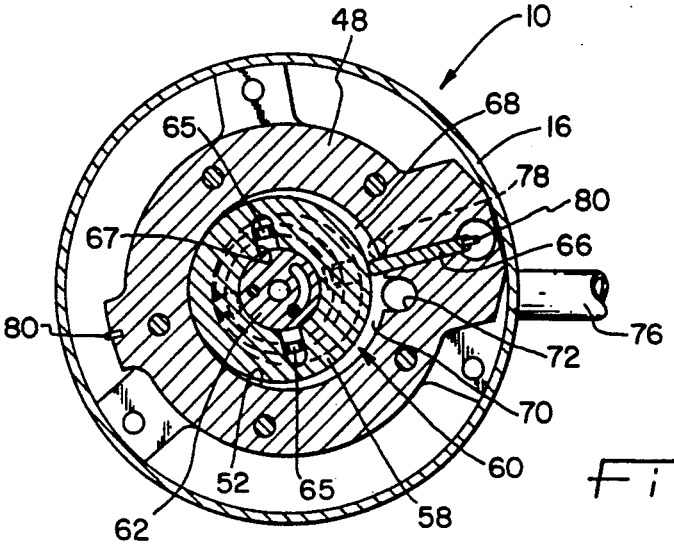
FIG. 3 is a sectional view taken along line 3—3 of FIG. 1.
Figure 4:
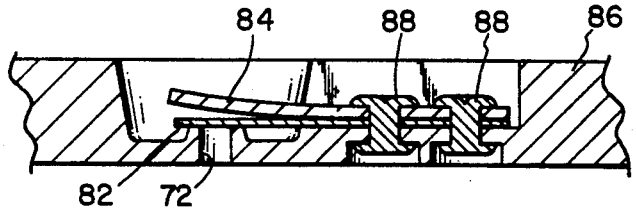
FIG. 4 is a sectional view taken along line 4—4 of FIG. 2.

Referring to FIGS. 1 and 3, there is shown a hermetically sealed compressor 10 having a housing 12. Housing 12 has a top portion 14, a central portion 16, and a bottom portion 18. The three housing portions are hermetically secured together as by welding or brazing. A mounting flange 20 is welded to bottom portion 18 for mounting the compressor in a vertically upright position.

Located within hermetically sealed housing 12 is an electric motor generally designated at 22 having a stator 24 and rotor 26. Stator 24 is provided with windings 28. Rotor 26 has a central aperture 30 provided therein into which is secured a crankshaft 32 by an interference fit. A terminal cluster (not shown) is provided in central portion 16 for connecting motor 22 to a source of electrical power. Crankshaft 32 will be more fully described. An example of another compressor with similar overall structure is disclosed in U.S. Pat. No. 4,875,838 and is incorporated herein by reference.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of cylindrical oil cup 44, which provides a quiet zone from which high quality, non-agitated oil is drawn.

FIG. 1 shows a compressor mechanism 46 disposed with housing 12. Compressor mechanism 46 comprises a cylinder 48 having a chamber 50 with a side wall 52. Cylinder 48 is mounted upon a main thrust bearing 54 by bolts 56. Thrust bearing 54 is also attached to central housing portion 16. Cylinder 48 includes a top plate 86 having an access hole 87 to provide access into cylinder 48.

Figure 6:
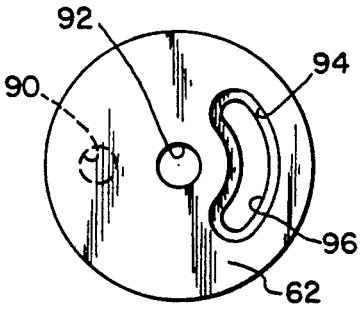
FIG. 6 is a plan view of the eccentric.

A roller 58 is eccentrically disposed within chamber 50 of cylinder 48 creating an inner pocket 60 as shown in FIG. 3. Roller 58 is connected to drive means such as crankshaft 32 by eccentric 62, shown in FIGS. 6 and 7, which is disposed within roller 58. Crankshaft 32 is journalled for rotation through thrust bearing 54 into engagement with eccentric 62.

Oldham ring 64 of conventional construction operates as an anti-rotation means in a known way between roller 58 and thrust bearing 54. Oldham ring 64 has a pair of axially extending tabs 65 that engage grooves 67 in roller 58. An other pair of tabs 69, perpendicular to tabs 65, extend axially from Oldham ring 64 engaging thrust bearing 54 within grooves 55. Roller 58 is allowed to orbit within chamber 50 but prevented from rotation since Oldham ring 64 can only slide within perpendicular grooves 55 and 67.

At least one vane 66 is slidingly disposed within cylinder 48 in sealing contact with roller 58 thereby dividing inner pocket 60 into at least two sections. One section is at suction pressure 68 and another section being at discharge pressure 70 (see FIG. 3). A suction tube 76 allows fluid at suction pressure to enter suction port 78 which in turn enters into suction pocket 68. A discharge port 72 allows fluid in discharge pocket 70 to communicate with housing 12. A discharge tube 74 disposed within top cover 14 allows fluid at discharge pressure to flow back to the condenser of a refrigeration system (not shown). Vane 66, dividing inner pocket 60 into a suction pressure section 68 and a discharge pressure section 70, is biased into sealing engagement with roller 58 by means of a C-shaped spring 80 (see FIG. 3).

On top of discharge port 72 is a discharge valve 82 over which a valve retainer 84 is located. The discharge port 72, discharge valve 82, and valve retainer 84 are all disposed within cylinder top plate 86 which is attached to cylinder 48 over chamber 50 and roller 58 by means of bolts 56. Valve retainer 84 and discharge valve 82 may be attached to the top plate 86 by means of rivets 88. Cylinder top plate 86 has an access hole 87 which is large enough to accept a tool, such as a screwdriver, for engaging the eccentric adjustment means described next.

Figure 7:
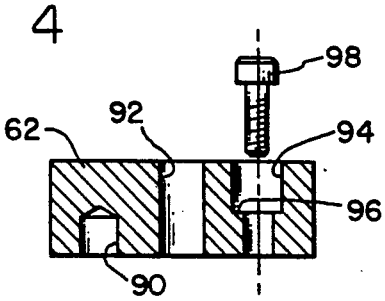
FIG. 7 is an elevational sectional view of the eccentric.

Eccentric 62 (FIG. 6) comprises a substantially cylindrical metal member having a dowel pin hole 90 and an oil passage 92: Kidney-shaped locking slot 94 is also formed in eccentric 62. As shown in FIG. 7, locking slot 94 includes a shoulder 96 upon which a locking means such as screw 98 may bear.

Figure 5:
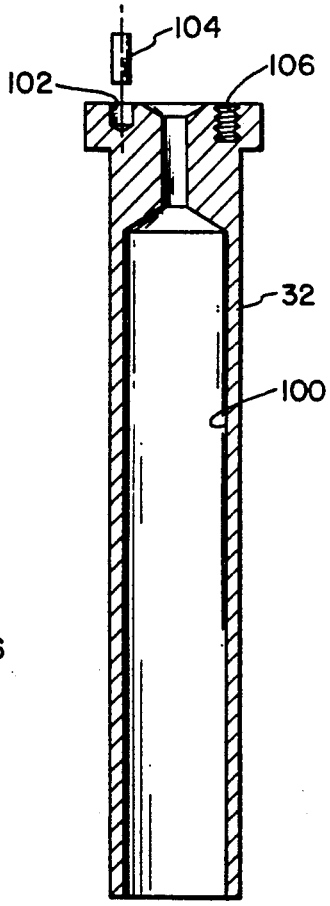
FIG. 5 is an enlarged longitudinal sectional view of the crankshaft.

A more detailed depiction of crankshaft 32 is shown in FIG. 5. Crankshaft 32 includes an axial oil passageway 100 in communication with oil pickup tube 38, (FIG. 1). Upon one axial face of crankshaft 32 is a dowel pin hole 102 wherein a dowel pin 104 is disposed (FIG. 5). Hole 90 of eccentric 62 is slid over dowel pin 104 so that eccentric 62 may temporarily pivot about dowel pin 104. Also on the same axial end of crankshaft 32 is a threaded hole 106 into which a locking means such as screw 98 may attach eccentric 62 to the crankshaft 32. As shown in FIG. 1, eccentric 62 is attached eccentrically to crankshaft 62 relative the axis of the crankshaft.

The adjustment method of the present invention comprises swinging roller 58 into contact with sidewall 52 then tightening screw 98 to lock eccentric 62 to crankshaft. More specifically, the method comprises swinging roller 58 around the inside of cylinder chamber 50 and rotating the eccentric 62 relative to the crankshaft 32 until roller 58 is in a position where it contacts sidewall 52 of chamber 50. This can be accomplished by turning crankshaft 32 with eccentric 62 in a loose condition until roller 58 engages wall 52. Then, with roller 58 in position, the eccentric 62 is locked to crankshaft 32 thereby fixing the eccentricity of the roller 58.

Figure 8:
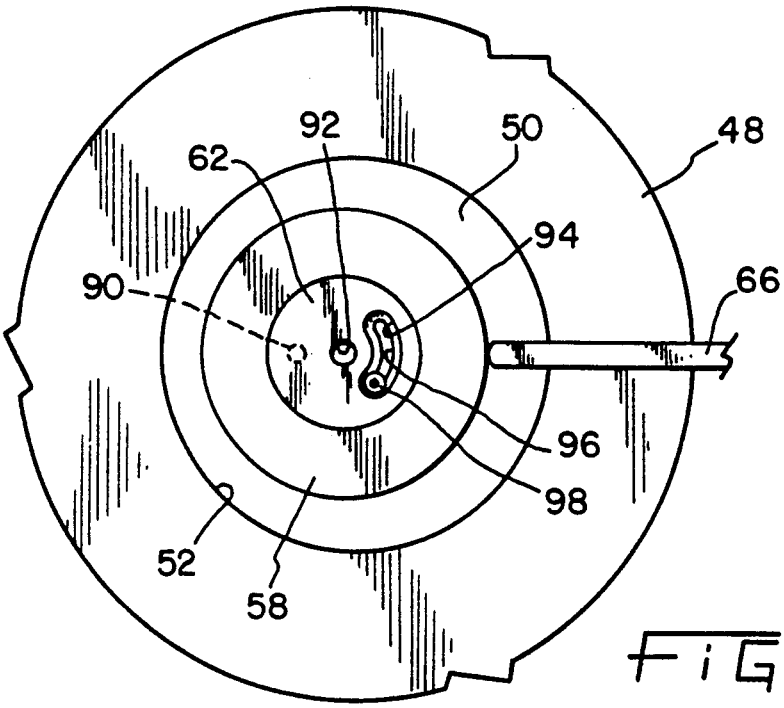
FIG. 8 is a transverse cross sectional view of the compressor of the present invention before the eccentricity of the roller is set.
Figure 9:
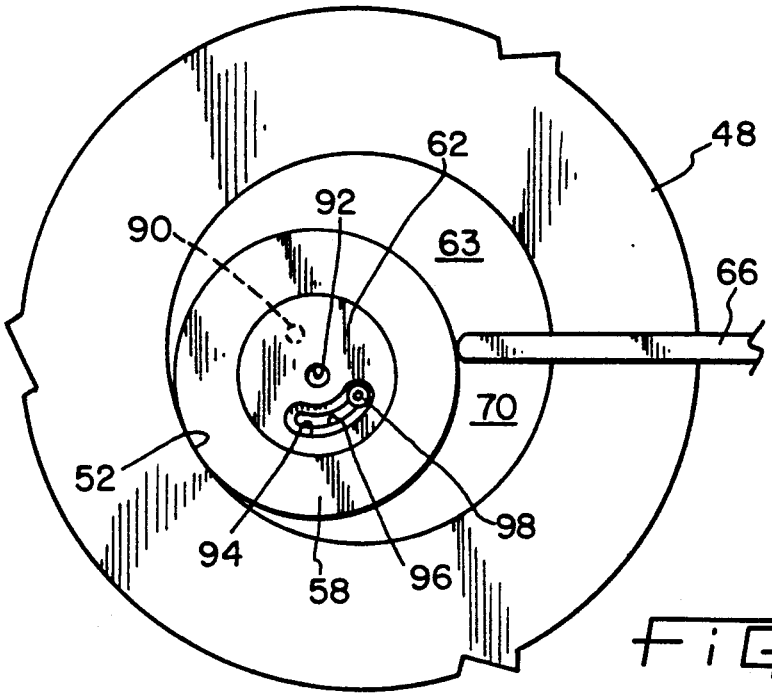
FIG. 9 is a transverse cross sectional view showing the compressor of the present invention after the eccentricity of the roller has been set.

FIG. 8 is a cutaway of compressor 10 showing roller 58 disposed out of contact with side wall 52. FIG. 9 shows the roller 58 after it has been swung around inside cylinder 48 into contact with sidewall 52 and eccentric 62 has pivoted about dowel pin 104. After this is done, eccentric 62 is locked into place upon crankshaft 32 by locking means such as screw 98 disposed within locking slot 94 and threaded hole 106. Screw 98 is driven by a screwdriver (not shown) that is inserted through access hole 87. Screw 88 engages shoulder 96 and locks eccentric 62 onto crankshaft 38 which permits a seal to be formed between roller 58 and sidewall 52 without the use of high precision parts.

Alternatively, instead of swinging roller 58 into contact with sidewall 52, a shim or spacer (not shown) could be inserted between roller 58 and sidewall 52 to set a minimum or specified clearance. This specified clearance would reduce roller 58 wear. After eccentric 62 has been locked into place upon crankshaft 32, shim or spacer is removed leaving a specified clearance space in which compressor lubricant will fill and seal during operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An orbiting rotary-type compressor for compressing refrigerant fluid, comprising:

a hermetically sealed housing;

a cylinder disposed within said sealed housing, said cylinder having a chamber including a side wall;

an orbiting cylindrical roller eccentrically disposed in said chamber creating in said chamber an inner pocket, said inner pocket having a portion at suction pressure and a portion at discharge pressure;

at least one vane for sealing between said suction pressure portion and said discharge pressure portion of said inner pocket;

a suction port and discharge port in communication with said inner pocket;

drive means for orbiting said orbiting roller within said chamber to expand and contract said inner pockets, said drive means comprising an electric motor attached on one side of said cylinder and a rotation prevention means;

adjustment means for adjusting the eccentricity of said roller in relation to said chamber;

said cylinder having an opening for accessing said adjustment means axially through said cylinder.

2. The compressor of claim 1 in which said rotation prevention means is an oldham ring.

3. The compressor of claim 1 in which said compressor is a high side compressor having fluid at suction pressure communicated by said suction port to said inner pocket and fluid at discharge pressure communicated from said inner pocket to said housing.

4. An orbiting rotary-type compressor for compressing refrigerant fluid, comprising:

a hermetically sealed housing;

a cylinder disposed within said sealed housing, said cylinder having a chamber including a side wall;

an orbiting cylindrical roller eccentrically disposed in said chamber creating in said chamber an inner pocket, said inner pocket having a portion at suction pressure and a portion at discharge pressure;

at least one vane for sealing between said suction pressure portion and said discharge pressure portion of said inner pocket;

a suction port and discharge port in communication with said inner pocket;

drive means for orbiting said orbiting roller within said chamber to expand and contract said inner pockets;

adjustment means for adjusting the eccentricity of said roller in relation to said chamber, said cylinder having an opening for accessing said adjustment means axially through said cylinder, said adjustment means comprising;

an eccentric having a top and bottom surface; said eccentric bottom surface pivotally engaging said drive means, said eccentric disposed within said roller, said eccentric having a locking slot extending through said eccentric; and locking means for locking said eccentric to said drive means, said locking means locking through said locking slot into said drive means to lock said eccentric to said drive means such that said eccentric is prevented from pivoting upon said drive means.

5. An orbiting rotary-type compressor for compressing refrigerant fluid, comprising:

a hermetically sealed housing;

a cylinder disposed within said sealed housing, said cylinder having a chamber including a side wall;

an orbiting cylindrical roller eccentrically disposed in said chamber creating in said chamber an inner pocket, said inner pocket having a portion at suction pressure and a portion at discharge pressure;

at least one vane for sealing between said suction pressure portion and said discharge pressure portion of said inner pocket;

a suction port and discharge port in communication with said inner pocket;

drive means for orbiting said orbiting roller within said chamber to expand and contract said inner pockets;

adjustment means for adjusting the eccentricity of said roller in relation to said chamber, said adjustment means comprising an eccentric having a top and bottom surface; said eccentric bottom surface pivotally engaging said drive means, said eccentric disposed within said roller, said eccentric having a locking slot extending through said eccentric; and locking means for locking said eccentric to said drive means, said locking means locking through said locking slot into said drive means to lock said eccentric to said drive means such that said eccentric is prevented from pivoting upon said drive means.

6. The compressor of claim 5 in which said eccentric pivots around a pin disposed between said eccentric and said drive means.

7. The compressor of claim 5 in which said locking means comprises a screw.

8. The compressor of claim 5 in which said locking slot includes an internal shoulder to which said locking means locks.

9. In a hermetic compressor having a roller eccentrically disposed in a cylinder chamber and operate by means of a drive mechanism having an eccentric connected to said roller and pivotally connected to a crankshaft, a method for adjusting the eccentricity of the roller comprising the steps of:

swinging said roller inside said cylinder chamber and rotating said eccentric relative to said crankshaft until said roller is in a position where it contacts a side wall of said cylinder chamber, and then with said roller in said position locking said eccentric to the crankshaft thereby fixing the eccentricity of the roller.

10. The method of claim 9 in which said locking step is accomplished by inserting a tool through said cylinder to lock said eccentric to said drive means.

11. In a hermetic compressor having a roller eccentricity disposed in a cylinder chamber and operated by means of a drive mechanism having an eccentric connected to said roller and pivotally connected to a crankshaft, a method for adjusting the eccentricity of the roller comprising the steps of:

swinging said roller inside said cylinder chamber and rotating said eccentric relative to said crankshaft until said roller is in a position where it contacts a side wall of said cylinder chamber, and then with said roller in said position locking said eccentric to the crankshaft by tightening a screw to said eccentric and said crankshaft, said screw extending through a slot in said eccentric thereby fixing the eccentricity of the roller.

12. The method of claim 11 in which said locking step is accomplished by inserting a tool through the top of the cylinder to lock said eccentric to said drive means.

13. In a hermetic compressor having a roller eccentrically disposed in a cylinder chamber and operated by means of a drive mechanism having an eccentric connected to said roller and pivotally connected to a crankshaft, a method for adjusting the eccentricity of the roller comprising the steps of:

swinging said roller inside said cylinder chamber and rotating said eccentric relative to said crankshaft until said roller is in a position of specified clearance from a side wall of said cylinder chamber, and then with said roller in said position locking said eccentric to the crankshaft thereby fixing the eccentricity of the roller.

14. The method of claim 13 in which said locking step is accomplished by inserting a tool through said cylinder to lock said eccentric to said drive means.

15. In a hermetic compressor having a roller eccentrically disposed in a cylinder chamber and operated by means of a drive mechanism having an eccentric connected to said roller and pivotally connected to a crankshaft, a method for adjusting the eccentricity of the roller comprising the steps of:

swinging said roller inside said cylinder chamber and rotating said eccentric relative to said crankshaft until said roller is in a position of specified clearance from a side wall of said cylinder chamber, and then with said roller in said position locking said eccentric to the crankshaft by tightening a screw to said eccentric and said crankshaft, said screw extending through a slot in said eccentric thereby fixing the eccentricity of the roller.

16. In a hermetic compressor having a roller eccentrically disposed in a cylinder chamber and operated a means of a drive mechanism having an eccentric connected to said roller and pivotally connected to a crankshaft, a method for adjusting the eccentricity of the roller comprising the steps of:

swinging said roller inside said cylinder chamber and rotating said eccentric relative to said crankshaft until said roller is in a position of specified clearance from a side wall of said cylinder chamber, and then with said roller in said position locking said eccentric to the crankshaft thereby fixing the eccentricity of the roller;

said locking step comprising tightening a fastener to said eccentric and said crankshaft, said fastener extending through a slot in said eccentric.

17. The method of claim 16 in which said locking step is accomplished by inserting a tool through the top of the cylinder to lock said eccentric to said drive means.

* * * * *